US008831268B2

(12) United States Patent
Yuan

(10) Patent No.: US 8,831,268 B2
(45) Date of Patent: Sep. 9, 2014

(54) MICRO-SPEAKER

(75) Inventor: Si-Long Yuan, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 161 days.

(21) Appl. No.: 13/454,311

(22) Filed: Apr. 24, 2012

(65) Prior Publication Data

US 2012/0269377 A1 Oct. 25, 2012

(30) Foreign Application Priority Data

Apr. 25, 2011 (CN) ..... 2011 2 0123420 U

(51) Int. Cl.
*H04R 25/00* (2006.01)

(52) U.S. Cl.
USPC ..... 381/386; 381/388; 381/395

(58) Field of Classification Search
CPC ..... H04R 25/00; H04R 1/02
USPC ..... 381/370–371, 386, 388–389, 395
See application file for complete search history.

(56) References Cited

U.S. PATENT DOCUMENTS

| | | | | |
|---|---|---|---|---|
| 4,852,178 | A * | 7/1989 | Inkman et al. | 381/395 |
| 6,061,460 | A * | 5/2000 | Seo | 381/388 |
| 8,023,680 | B2 * | 9/2011 | Hayasaka et al. | 381/386 |

* cited by examiner

*Primary Examiner* — Suhan Ni
(74) *Attorney, Agent, or Firm* — Anova Law Group, PLLC

(57) ABSTRACT

A micro-speaker includes a case having a ring wall forming a receiving cavity, a number of restricting apertures formed in the ring wall, a magnetic plate received in the case and having a main plate, a plurality of auxiliary plates extending from the main plate, and a number of protrusions extending from edges of the auxiliary plates, a first gap formed between two adjacent auxiliary plates communicating with the receiving cavity of the case, the main plate and the auxiliary plates being surrounded by the ring wall of the case, and the protrusions being located in the restricting apertures for restricting the magnetic plate in proper position.

11 Claims, 2 Drawing Sheets

MICRO-SPEAKER

FIELD OF THE INVENTION

The present invention relates to the art of electroacoustic transducers, and more specifically to a micro-speaker used in a portable device, such as a mobile phone, TV and computer, etc.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of speaker have been developed. A speaker is generally coupled to an audio equipment or an amplifier for use as a large sound producing means for considerably amplifying volume. Alternatively, the speaker may be used as a small sound producing means having a small size and volume.

An electronic device, such as a cellular phone, a camcorder, a PDA, a digital camera, or a notebook computer, provides a space for accommodating a speaker therein. Nowadays, a speaker with high quality audio performance and miniature size is desired.

A related micro-speaker comprises a case, a magnetic circuit part having a yoke positioned in the case, a pole plate and a magnet disposed in the yoke, a diaphragm supported by the case, a voice coil directly or indirectly attached to the diaphragm, and a cover pressing on a peripheral portion of the diaphragm. The case and the cover corporately form a cavity. For electrically connecting the speaker to an external PCB, a plurality of terminals is provided and is connected to leads of the voice coil. When alternating currents go through the voice coil, the magnet will drive the voice coil to vibrate and the diaphragm will also vibrate with the voice coil accordingly, which converts the currents into sound waves.

However, glue scattered unequally over a bottom plate of the yoke during the process of installation, and leads to the bottom plate cannot be accurately fixed in the case.

So, it is necessary to provide a new micro-speaker for solving the problem mentioned above.

BRIEF DESCRIPTION OF THE DRAWINGS

Many aspects of the exemplary embodiment can be better understood with reference to the following drawings. The components in the drawings are not necessarily drawn to scale, the emphasis instead being placed upon clearly illustrating the principles of the embodiment.

DETAILED DESCRIPTION OF THE EXEMPALRY EMBODIMENT

Reference will now be made to describe the exemplary embodiment of the present invention in detail.

An embodiment of the micro-speaker of the present invention is used for converting audio electrical signals to audible sounds. The micro-speaker comprises a case, a magnetic circuit having a magnetic gap, a vibrating unit and a cover coupled to the case. The vibrating unit comprises a diaphragm supported by the case and a voice coil directly or indirectly connected to the diaphragm. The cover presses on a peripheral portion of the diaphragm for fixing the diaphragm to the case. The cover and the case corporately define a cavity for accommodating the components mentioned above therein. The voice coil is partially received in the magnetic gap of the magnetic circuit.

Figure 1:
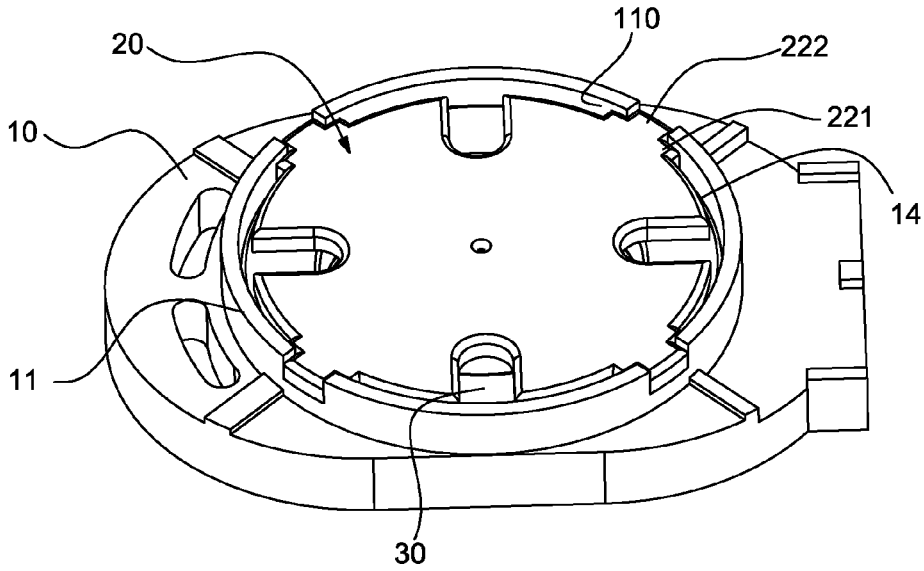
FIG. 1 is an isometric view of a micro-speaker in accordance with an exemplary embodiment of the present invention.
Figure 2:
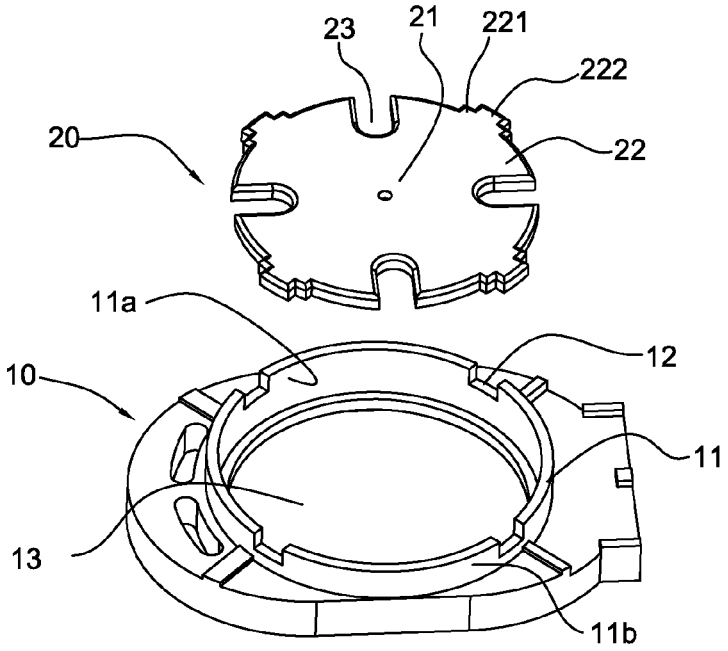
FIG. 2 is an exploded view of the micro-speaker in FIG. 1 only showing a magnetic plate ready to be assembled with a case.

Referring to FIGS. 1-2, a speaker 100 in accordance with an exemplary embodiment of the present invention comprises a case 10 having a receiving cavity 13 with an opening, a vibrating unit supported by the case, a magnetic plate 20 covering the opening of the cavity 13, and a magnetic circuit received in the receiving cavity 13 and carried by the magnetic plate 20. The case 10 includes a ring wall 11 extending toward the magnetic plate 20 for forming the cavity 13. The ring wall 11 defines a plurality of restricting apertures 12, the restricting aperture 12 being a through gap extending from the outer surface 11*b* of the ring wall 11 to the inner surface 11*a* of the ring wall 11. The magnetic circuit generally comprises a magnetic gap formed by a magnet and a yoke, or formed by two separated magnets. The vibrating unit generally comprises a diaphragm fixed to the case 10 and a coil driving the diaphragm. The disclosure focuses on the engagement of the magnetic plate 20 and the case 10. So, the magnetic circuit and the vibrating unit are not illustrated in the drawings. Even though the magnetic circuit and the vibrating unit are not illustrated in the drawings, the magnetic circuit and the vibrating unit are necessary components to manufacture a finished micro-speaker. The magnetic circuit and the vibrating unit can be obtained in the public-known arts. The shapes, forms, engagement relationships, and sizes of the elements of the magnetic circuit and the vibrating unit do not affect the cooperation or engagement of the case and the magnetic plate. A person with ordinary skill in the art, after reviewing the present disclosure, can use a public known magnetic circuit and a vibrating unit to assemble with the combination of the case 10 and the magnetic plate 20 to make a micro-speaker.

Figure 3:
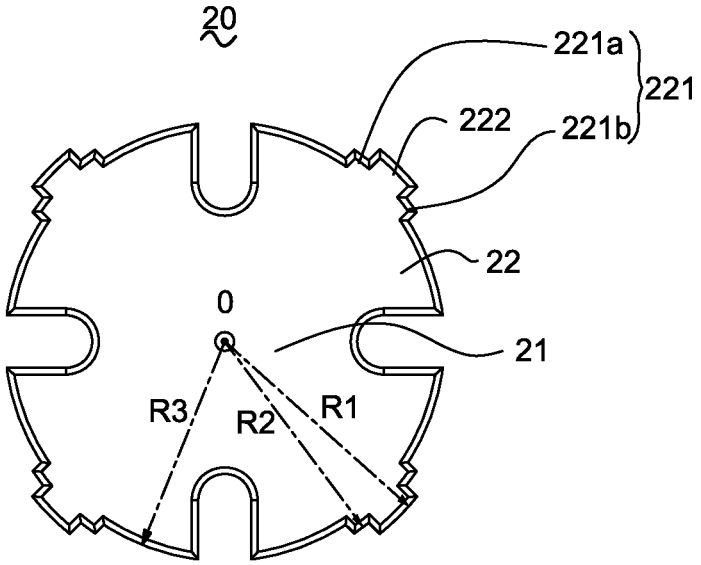
FIG. 3 is a top view of the magnetic plate of the micro-speaker.

Referring to FIGS. 2-3, the magnetic plate 20 includes a main plate 21 and a plurality of auxiliary plates 22 extending from the main plate 21, and a first gap 23 formed between two adjacent auxiliary plates 22. While the magnetic plate 20 is assembled with the case 10, the first gap 23 communicates with the receiving cavity 13, which enables balancing the air pressure in receiving cavity 13 and the air outside of the case 10. In the present embodiment, four auxiliary plates 22 are provided extending from the main plate 21. Each of the auxiliary plates 22 includes at least one protrusion 222 extending from an edge of the auxiliary plate 22 and corresponding to one of the restricting apertures 12. In other words, while assembled, the protrusions 222 are located in the restricting apertures 12 for positioning the magnetic plate 20 in proper position.

The magnetic plate 20 further includes a plurality of steps 221 connecting the edge of the auxiliary plates 22 and the protrusions 222. For each one protrusion 222, two steps 221*a*, 221*b* are separately positioned at both sides of the protrusion 222, respectively. In fact, the step 221 may not connect to the protrusion 222, and the step 221 may extend from the edge of the auxiliary plate 22 toward the end of the protrusion 222. Furthermore, especially referring to FIG. 3, a distance R1 from any point at the most outer edge of protrusion 222 to a center point O of the main plate 21 is greater than a distance R2 from any point at the most outer edge of step 221 to the center point O of the main plate 21. Similarly, the distance R2 is greater than a distance R3 from any point at the edge of auxiliary plate 22 to the center point O of the main plate 21.

Referring back to FIGS. 1-2, while the magnetic plate 20 is assembled with the case 10, the main plate 21 and the auxiliary plates 22 are surrounded by the ring wall 11 of the case 10. The steps 221 contact the inner surface 11*a* of the ring wall 11, and the protrusions 222 locate in the restricting apertures 12. A second gap 14 is accordingly formed between the inner surface 11*a* of the ring wall 11 and the edge of the auxiliary plate 22. In the exemplary embodiment, four protrusions 222 are fixed in four restricting apertures 12, and eight steps respectively contact the inner surface 11*a* of the ring wall 11. The steps 221 and the protrusions 222 are used for fixing the magnetic plate in proper position. The steps 221 are used for restricting the position of the magnetic plate 20 in a radial direction of the main plate 21 thereof, and the protrusions 222 are used for restricting rotation of the magnetic plate 20 in the plane where the magnetic plate 20 locates.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A micro-speaker, comprising:

a case defining a ring wall forming a receiving cavity, the receiving cavity penetrating the case, the ring wall defining a plurality of restricting apertures therein, the restricting aperture being a through gap extending from the outer surface of the ring wall to the inner surface of the ring wall;

a plate-shaped magnetic plate including a main plate, a plurality of auxiliary plates extending from the main plate, and a plurality of protrusions extending from edges of the auxiliary plates in a radial direction of the auxiliary plate, the main plate and the auxiliary plates being surrounded by the ring wall of the case, and the protrusions being located in the restricting apertures for restricting the magnetic plate in proper position;

a first gap formed between two adjacent auxiliary plates communicating with the receiving cavity of the case.

2. The micro-speaker as described in claim 1, wherein the magnetic plate further has a plurality of steps connecting the auxiliary plates and the protrusions.

3. The micro-speaker as described in claim 2, wherein for each protrusion, two steps are provided connecting two sides of the protrusion to the corresponding auxiliary plate.

4. The speaker as described in claim 3, wherein the ring wall has an inner surface, and the steps contact the inner surface of the ring wall.

5. The speaker as described in claim 2, wherein a distance from any point at the most outer edge of step to a center point of the magnetic plate is greater than a distance from any point at the edge of auxiliary plate to the center point of the magnetic plate.

6. The speaker as described in claim 5, wherein a distance from any point at the most outer edge of the protrusion to the center point of the magnetic plate is greater than a distance from the center point to the most outer edge of the step.

7. The speaker as described in claim 6, wherein a second gap is formed between the inner surface of the ring wall and the steps.

8. The micro-speaker as described in claim 1, wherein the magnetic plate further comprises a plurality of steps extending between the edges of the auxiliary plates and the ring wall, and the steps contact the inner wall of the case.

9. The micro-speaker as described in claim 8, wherein each two adjacent auxiliary plates form a gap communicating with the receiving cavity, the gap defining a first recess and a second recess located on the main plate of the magnetic plate.

10. The micro-speaker as described in claim 9, wherein the first recess between the ring wall and the edges of the auxiliary plates communicates with the second recess between two adjacent auxiliary plates, the second recess is communicating with the receiving cavity.

11. The micro-speaker as described in claim 8, wherein a distance from a center point of the main plate to the ring wall is greater than a distance from the center point of the main plate to any point at the most outer edge of step.

* * * * *